US005826877A

United States Patent [19]

Glassman

[11] Patent Number: 5,826,877

[45] Date of Patent: Oct. 27, 1998

[54] METHOD OF PLAYING A SAFETY FIRST BOARD GAME

[76] Inventor: Lauren B. Glassman, 36 Old Phillips Hill Rd., New City, N.Y. 10956

[21] Appl. No.: 880,553

[22] Filed: Jun. 23, 1997

[51] Int. Cl.[6] ..... A63F 3/00; A63F 9/18

[52] U.S. Cl. ..... 273/249; 273/251; 273/431

[58] Field of Search ..... 273/243, 249–254, 273/429–432

[56] References Cited

U.S. PATENT DOCUMENTS

| | | | |
|---|---|---|---|
| 4,273,337 | 6/1981 | Carrera et al. | 273/243 |
| 5,308,079 | 5/1994 | Dreznick et al. | 273/249 |
| 5,472,207 | 12/1995 | Sullivan, Jr. et al. | 273/249 |

FOREIGN PATENT DOCUMENTS

| | | | |
|---|---|---|---|
| 1263126 | 11/1989 | Canada | 273/249 |
| 2198361 | 6/1988 | United Kingdom | 273/249 |
| 2254565 | 10/1992 | United Kingdom | 273/249 |

*Primary Examiner*—Benjamin H. Layno

[57] ABSTRACT

A safety game including a game playing area divided into six regions. The six regions include a first region, a second region, a third region, a fourth region, a fifth region and a sixth region. The game playing area has a path of travel extending between the six regions. The path of travel has a starting point in the first region and a finishing point comprising the sixth region. The first five regions correspond to an area a child frequents. A plurality of game pieces are included for movement around the path of travel. A spinning wheel for determining movement around the path of travel is also included. A plurality of sets of question cards correspond to the first five regions of the game board.

1 Claim, 7 Drawing Sheets

METHOD OF PLAYING A SAFETY FIRST BOARD GAME

BACKGROUND OF THE INVENTION

1. Field of the Invention

The present invention relates to a safety game and more particularly pertains to preparing children for dealings with life threatening situations as well as everyday stressful situations with a game featuring wise safety choices.

2. Description of the Prior Art

The use of games is known in the prior art. More specifically, games heretofore devised and utilized for the purpose of increasing safety awareness are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,635,939 to Makow; U.S. Pat. No. 4,731,026; U.S. Pat. No. Des. 342,972 to Diedrich et al.; U.S. Pat. No. 5,183,258 to Lerke; U.S. Pat. No. 4,815,607 to Agapiou; and U.S. Pat. No. 5,351,955 to Danby.

While these devices fulfill their respective, particular objective and requirements, the aforementioned patents do not describe a safety game for preparing children for dealings with dangerous situations.

In this respect, the safety game according to the present invention substantially departs from the conventional concepts and designs of the prior art, and in doing so provides an apparatus primarily developed for the purpose of preparing children for dealings with dangerous situations.

Therefore, it can be appreciated that there exists a continuing need for new and improved safety game which can be used for preparing children for dealings with dangerous situations. In this regard, the present invention substantially fulfills this need.

SUMMARY OF THE INVENTION

In the view of the foregoing disadvantages inherent in the known types of games now present in the prior art, the present invention provides an improved safety game. As such, the general purpose of the present invention, which will be described subsequently in greater detail, is to provide a new and improved safety game and method which has all the advantages of the prior art and none of the disadvantages.

To attain this, the present invention essentially comprises a game with a playing area divided into six regions of play whereby safety questions specific to the first five regions are presented. The six regions include a first region, a second region, a third region, a fourth region, a fifth region and a sixth region. The playing area has a path of travel extending between the regions. The path of travel has a starting point in the first region and a finishing point in the sixth region. The first region is designated as a bus stop and neighborhood. The second region is designated as a school. The third region is designated a playground. The fourth region is designated a fire department. The fifth region is designated a shopping mall. The sixth region is a safety zone. A plurality of game pieces are provided. Each of the game pieces resembles a small child for movement around the path of travel. A numbered spinning wheel is provided for determining movement around the path of travel. Six sets of question cards correspond to the first five regions of the game board. A first set of questions relate to situations occurring at a bus stop. A second set of questions relate to situations occurring in a neighborhood. A third set of questions relate to situations occurring at school. A fourth set of questions relate to situations occurring on a playground. A fifth set of questions relate to fire safety. A sixth set of questions relate to situations occurring at a shopping mall.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety game which has all the advantages of the prior art games and none of the disadvantages.

It is another object of the present invention to provide a new and improved safety game which may be easily and efficiently manufactured and marketed.

It is a further object of the present invention to provide a new and improved safety game which is of durable and reliable construction.

An even further object of the present invention is to provide a new and improved safety game which is susceptible of a low cost of manufacture with regard to both materials and labor, and which accordingly is then susceptible of low prices of sale to the consuming public, thereby making such a safety game economically available to the buying public.

Even still another object of the present invention is to provide a new and improved safety game for preparing children for dealings with dangerous situations.

Lastly, it is an object of the present invention to provide a new and improved safety game including a playing area divided into six regions. The six regions include a first region, a second region, a third region, a fourth region, a fifth region and a sixth region. The playing area has a path of travel extending between the regions. The path of travel has a starting point in the first region and a finishing point in the sixth region. The first five regions correspond to an area a child frequents. A plurality of game pieces are included for movement around the path of travel. A spinning wheel for determining movement around the path of travel is also included. A plurality of sets of question cards corresponds to the first five regions of the game board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

It should be noted that FIGS. 4 through 7 are representative of four quadrants of the playing area and when combined comprise a cohesive playing area. FIG. 4 comprises the upper left quadrant, FIG. 5 comprises the upper right quadrant, FIG. 6 comprises the lower left quadrant and FIG. 7 comprises the lower right quadrant. FIGS. 4 and 5, when placed side by side, comprise the top half of the playing area and FIGS. 6 and 7, the bottom half. In this manner, the path of travel is clearly defined. The same reference numerals refer to the same parts through the various figures.

DESCRIPTION OF THE PREFERRED EMBODIMENT

Figure 1:
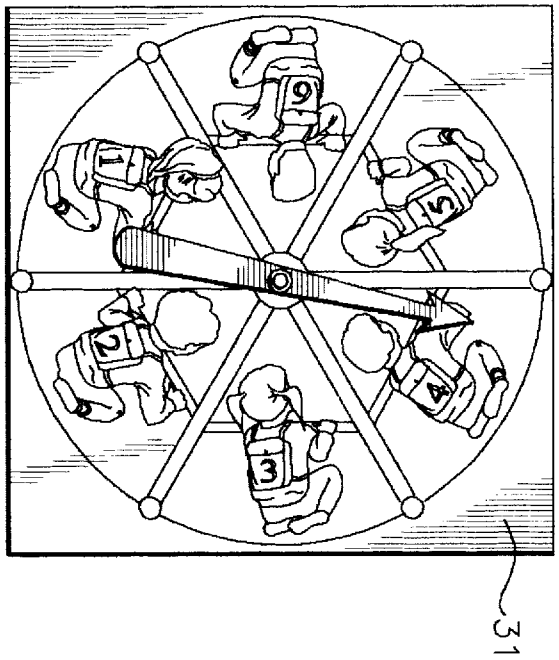
FIG. 1 is a plan view of the spinning wheel of the safety board game constructed in accordance with the principles of the present invention.
Figure 8:
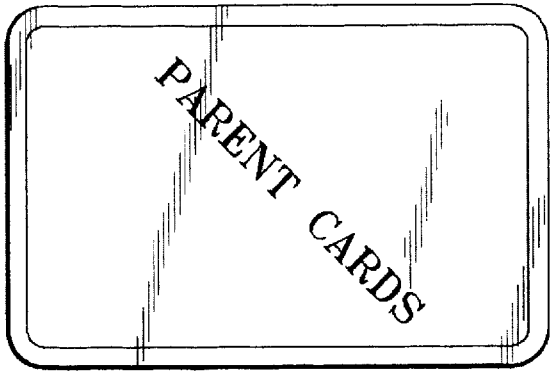
FIG. 8 is a plan view of the optional parent cards of the present invention.
Figure 2A:
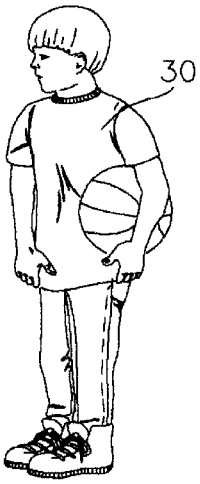
FIG. 2*a* through 2*h* are front views of the game pieces of the present invention.
Figure 2B:
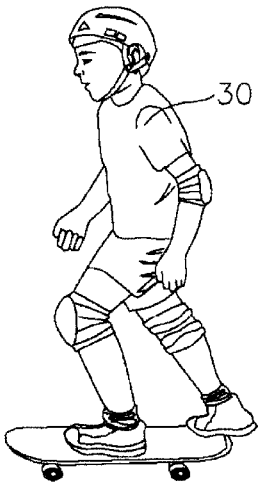
Figure 2C:
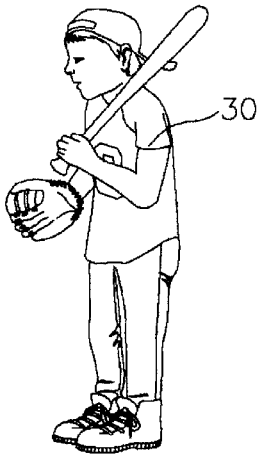
Figure 2D:
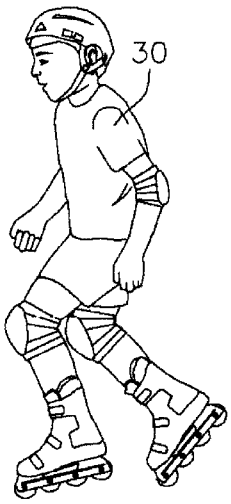
Figure 2E:
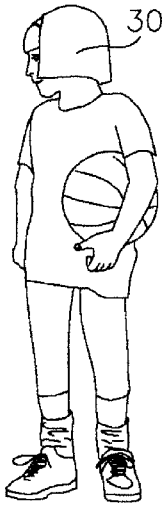
Figure 2F:
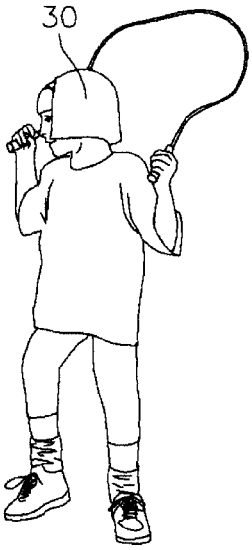
Figure 2G:
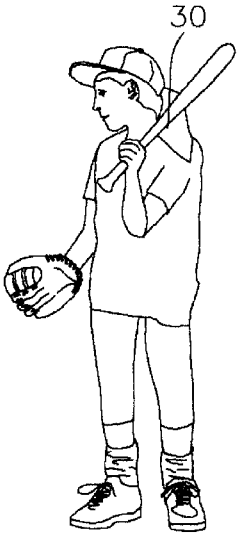
Figure 2H:
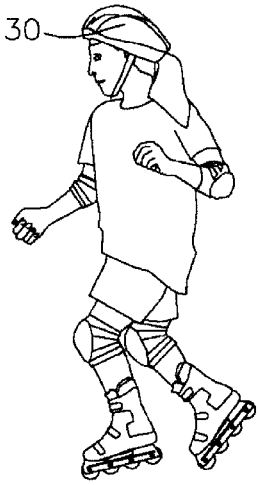
Figure 3A:
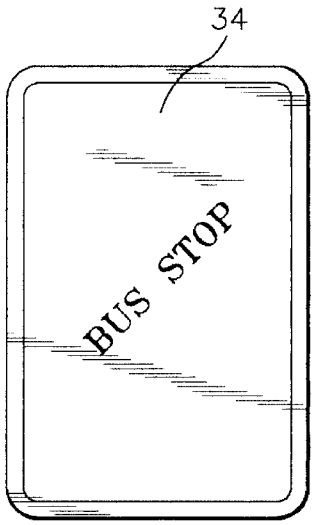
FIG. 3*a* through 3*f* are front views of the categories of questions of the present invention.
Figure 3B:
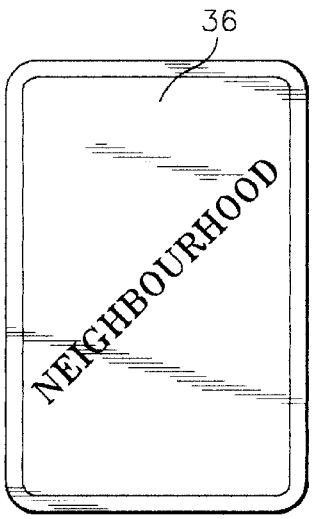
Figure 3C:
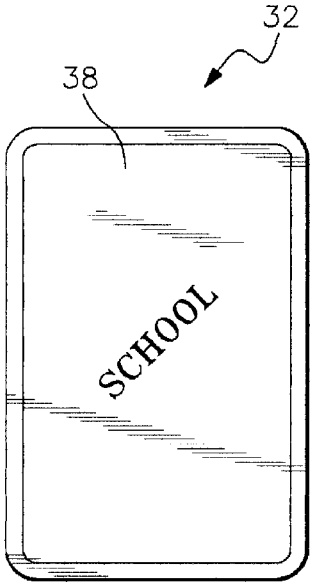
Figure 3D:
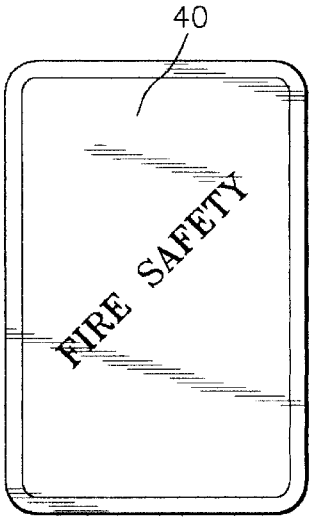
Figure 3E:
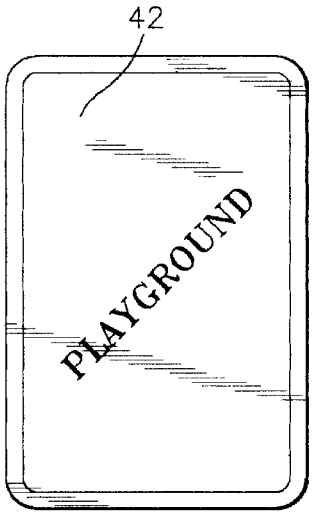
Figure 3F:
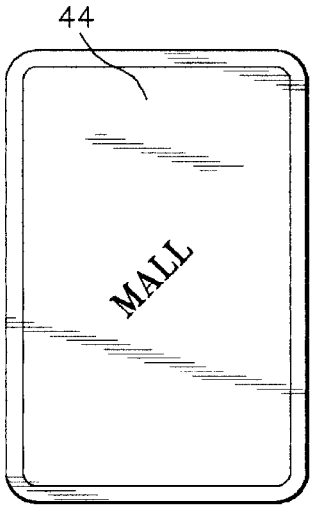
Figure 4:
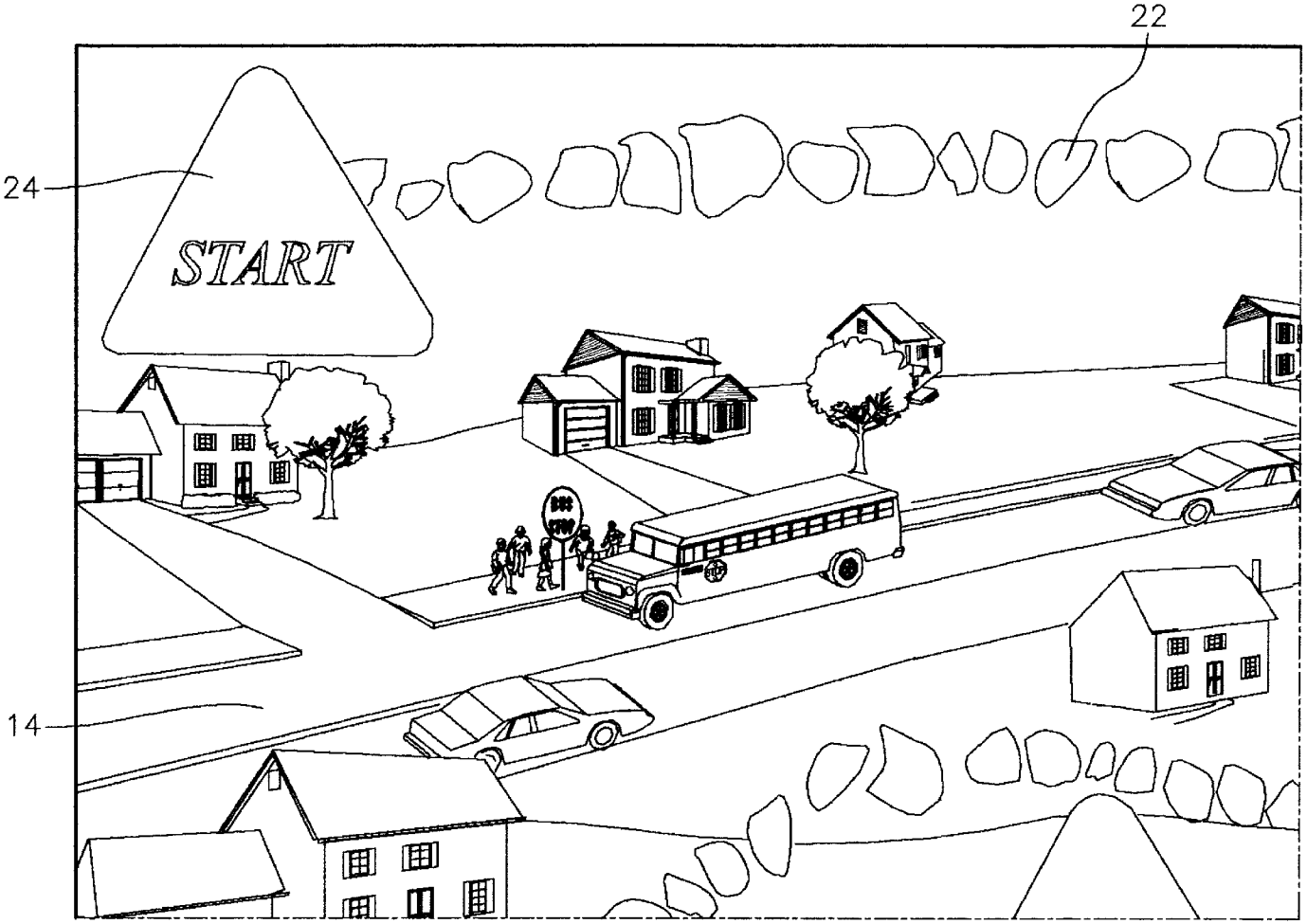
FIG. 4 is a plan view of the bus stop and neighborhood region of the game board.
Figure 5:
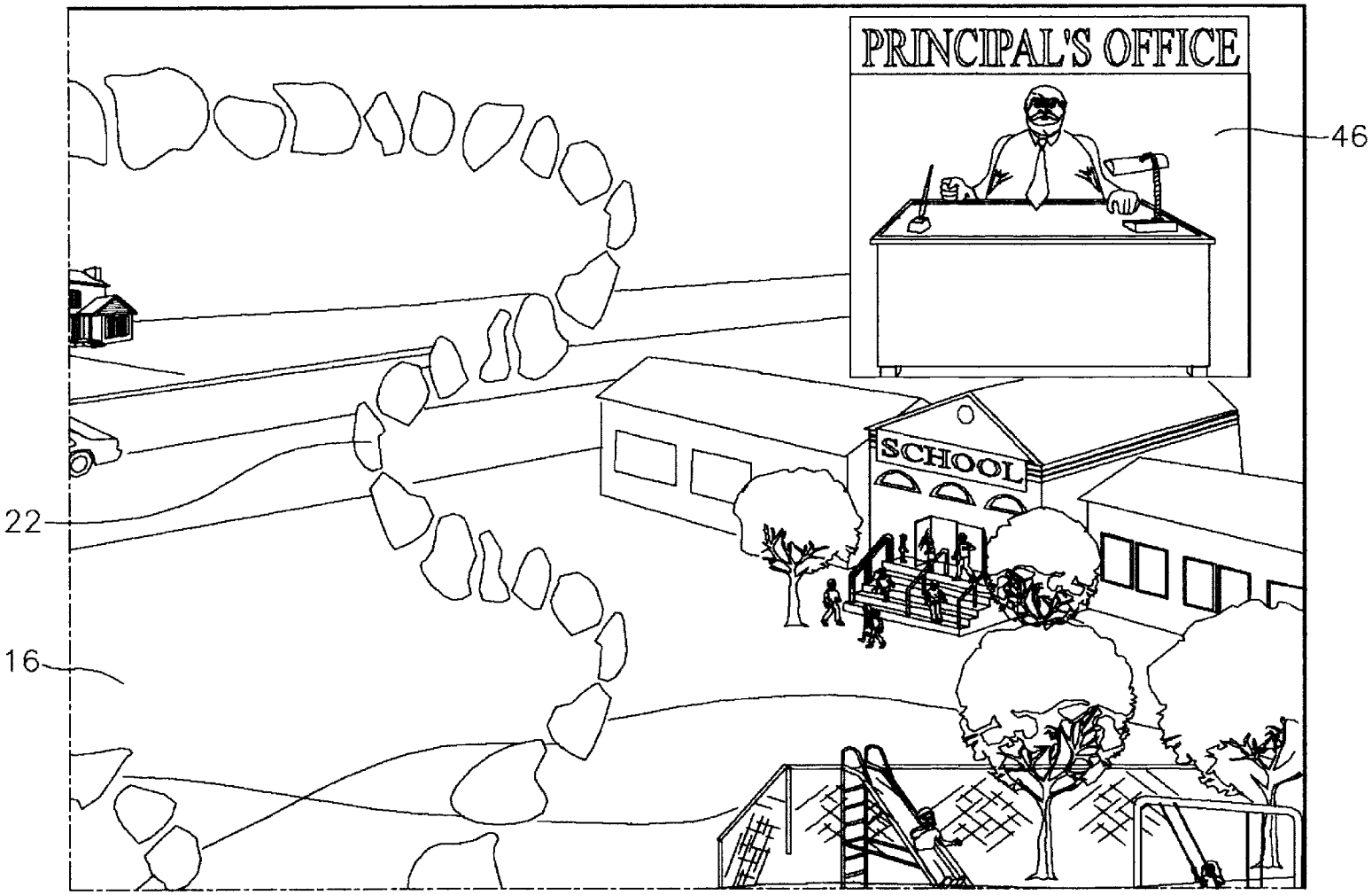
FIG. 5 is a plan view of the school region and a partial plan view of the playground region of the game board.
Figure 6:
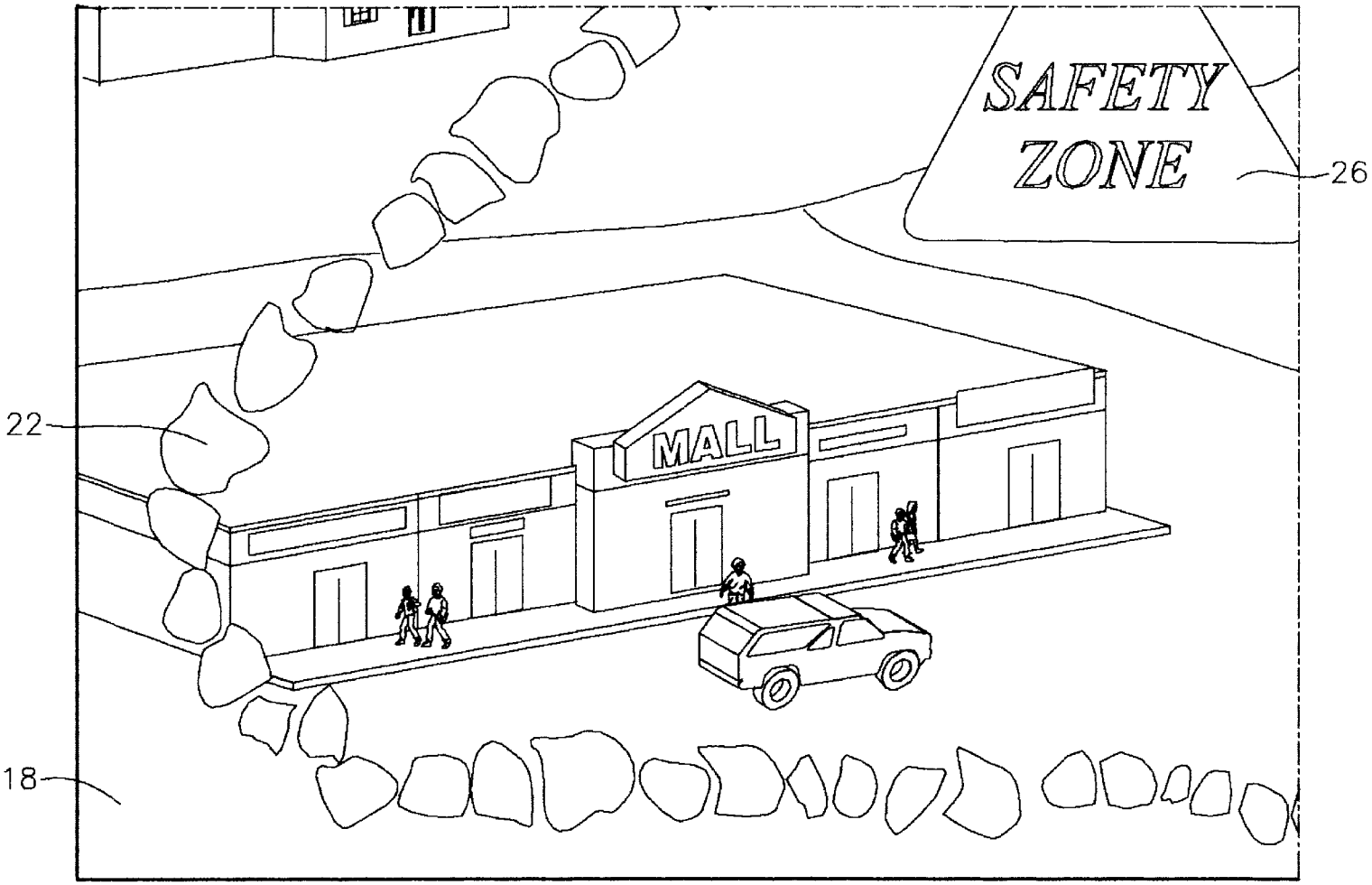
FIG. 6 is a plan view of the shopping mall region and safety zone region of the game board.
Figure 7:
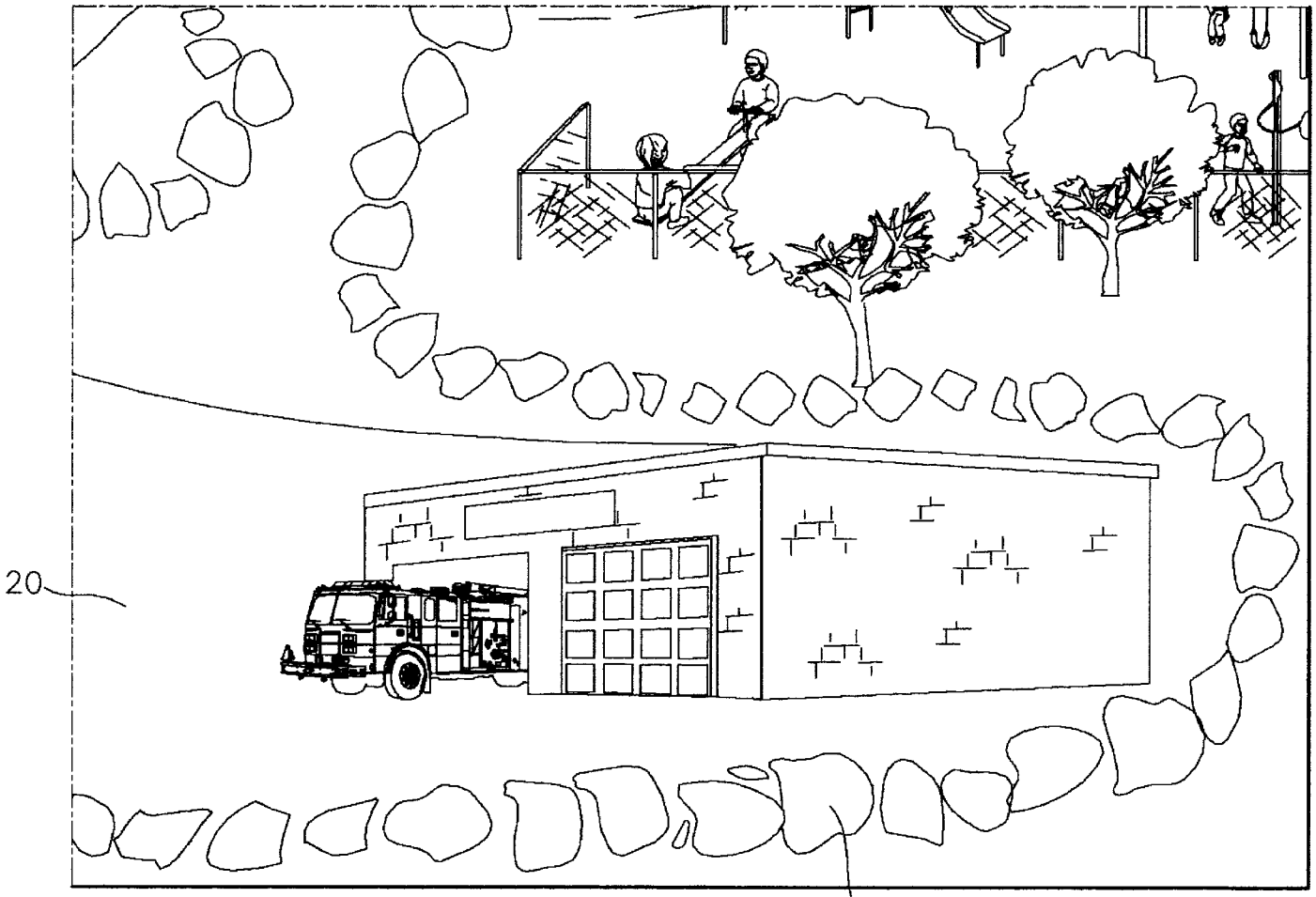
FIG. 7 is a partial plan view of the playground region and fire department/safety region of the game board.

With reference now to the drawings, and in particular, to FIGS. 1 through 8 thereof, the preferred embodiment of the new and improved safety game embodying the principles and concepts of the present invention will be described.

Specifically, it will be noted in the various Figures that the device relates to a safety game for preparing children for dealings with dangerous situations. In its broadest context, the device consists of a game playing area, a plurality of playing pieces, a spinning wheel, six sets of questions for children and an optional set of parent playing cards. Such components are individually configured and correlated with respect to each other so as to attain the desired objective.

The game playing area 10 is divided into six regions of play, with a starting point 12 located in the first region. The six regions include a first region 14, a second region 16, a third region 18, a fourth region 20, a fifth region 22 and a sixth region 24. The game board has a path of travel 26 extending between the regions. The path of travel 26 in the preferred embodiment resembles stepping stones that curve through the first five regions and terminates at the sixth region. The path of travel 26 has a starting point 12 in the first region 14 and a finishing point 24 comprising the sixth region. The finishing point 24 is designated the safety zone. The first section 14 is designated as a bus stop and neighborhood. The second region 16 is designated a school. The third region 18 is designated a playground. The fourth region 20 is designated a fire department/fire safety section, the fifth region 22 is designated a shopping mall and the sixth region is designated as a safety zone. The six regions of play are illustrated in FIGS. 4 through 7 which, when taken in combination as explained in the Brief Description of the Drawings, comprise the playing area 10. Note is taken that two of the regions, the playground 18 and the safety zone 24, span two quadrants.

The plurality of game pieces 30 resemble small children. The game pieces 30 are utilized for movement around the path of travel 26. The game pieces 30 are illustrated in FIGS. 2*a* through 2*h*.

The numbered spinning wheel 31 is provided for determining movement around the path of travel 26. The spinning wheel 31 is illustrated in FIG. 1 and resembles children seated on a merry-go-round with each child having a backpack on their back with a number thereon with the number corresponding to the number of spaces along the path of travel 26 to move.

The six sets of question cards 32 correspond to the first five regions of the game playing area. A first set 34 of questions relate to situations occurring at a bus stop. A second set 36 of questions relate to situations occurring in a neighborhood. A third set 38 of questions relate to situations occurring at school. A fourth set 40 of questions relate to situations related to situations on a playground. A fifth set 42 of questions relate to fire safety. A sixth set 44 of questions relate to situations occurring at a shopping mall. It is preferred that each of the regions is colored one of six different ways and that the backs of the question cards of each set of questions is of a color corresponding to the color of the region to which the questions apply.

To provide an optional way of play, the set of parent cards 50 are provided so that the child playing with a parent or other adult may direct the questions to the parent, rather than parent to child, as in the play relating to safety issues.

To start the game, each player begins by selecting a game piece 30. Each player then spins the numbered spinning wheel 31 to determine movement around the path of travel 26. As the players move through the different regions on the game playing area 10 they will pick up one of the question cards pertaining to the region of the playing area 10 they are in. If the question is not answered correctly, they must return to their previous location until their next turn. When their turn comes around they will spin again and try to move forward. When in the school and playground regions, a location marked "The Principal" 46 will be the place where they will be sent if the question is not answered correctly. A player sent to the location marked "The Principal" remains there if the player continues to answer questions incorrectly on the player's next subsequent turns. Only a correct answer will allow the player to leave the location marked "The Principal" and continue the game. Once a child reaches the finishing point, designated the safety zone 24, they will win the game.

Examples of questions include:

You are playing in your backyard. A man walks into your yard and grabs your arm very hard. He is trying to pull you. What do you do???

While walking to the bus stop, a car stops and the driver asks if you would like a ride to school. What do you do???

You are home and everyone is sleeping. You hear a noise outside your window and you are very scared. What do you do???

You are in your house watching television and you are home alone. You hear a window smash in another room. What do you do???

A teacher at school hits you hard and hurts you. What do you do???

You are in music class. The boy sitting next to you gets a nosebleed and blood is dripping everywhere. What do you do???

You are walking home from school, and a man stops his car to ask you a question. You see that he is naked. What do you do???

You are walking home from school and your neighbors nasty dog starts to chase you. You are scared. What do you do?

While playing in your bedroom you smell smoke. What do you do???

While in the mall you lose your parents. You are lost. What do you do???

You are in a store shopping with your friend and his mother. A man walks over to you and touches your private areas. He then walks away! What do you do???

In an optional way of play, a set of parent cards are provided so that the child playing with a parent or other adult may direct the questions to the adult, rather than parent to child, as in the play relating to safety issues. The questions utilized by the child via the parent cards deal with the adult's past, present and future. By asking these questions, and having them answered, the child will be better able to know their parents as people (not just a role, ie. mother, father, caregiver, etc.), thus fostering a closer relationship. Additionally, children love to hear about their parent's lives when they were children. Examples of the questions the child may ask the adult include:

Where were you born?

What color is your mother's eyes?

What was your most embarrassing moment as a child?

What was your first job?

How old were you when you got married?

What did you want to be when you grew up?

Did you have video games when you were my age?

What is your favorite movie—color—food, etc.?

Do you like long or short hair on boys, on girls?

Where would you like to go on a trip?

Do you want grandchildren one day?

In an alternate embodiment, the game could optionally be set up as a Compact Disc (CD) Read Only Memory (ROM) software game whereby all of the components of the game are integrated into the computer software so that the game may be played on a computer. The computer will include a screen showing an image equivalent to the playing area 10 of FIGS. 4 through 7. In this embodiment, the game will be played by the elementary school age child by him/herself. The child will sit at the computer and answer the same questions utilized in the board version of the game. However, when the child answers incorrectly, he/she will be able to see the consequence of their answer on the screen. For example, if the child chooses to pick up their bookbag which has fallen under the bus as the bus is leaving the bus stop, the child will witness him/herself being run over by the bus. In the fire safety region, if he/she chooses the wrong answer, a visualization of being in a fire and possibly being killed will appear. The game will be set up to show the consequences of actions without the child actually ever having the misfortune of the actual experience. The child playing will collect points for correct answers. When a predetermined number of points are collected, a party is given for the child by the children in the computer version of the game. If the child playing consistently answers incorrectly, another child in the computer version appears and sits on a rock and has a chat with the playing child. The purpose of the game is to make a child think and learn so that if he/she is ever in a similar situation the correct and safe response will be a conscious one based upon prior knowledge gained through the playing of the safety game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A method of playing a safety board game for preparing children for dealings with dangerous situations comprising, in combination the step of:

providing a game board divided into four sections, the four sections including a first section, a second section, a third section and a fourth section, the game board having a path of travel divided into a plurality of location extending between the sections, wherein each section constitutes a quadrant of the game board, the path of travel having a starting point on the first section and a finishing point on the fourth section and the location marked to resemble stepping stones, the first section being designated a bus stop and neighborhood section, the second section being designated a school section, the third section being designated a shopping mall section, the fourth section being designated a playground and fire safety section and a location marked "The Principal" located at an area remote from the path of travel;

providing a plurality of game pieces, each of the game pieces resembling a small child for movement around the path of travel;

providing a numbered spinning wheel for determining movement around the path of travel, wherein the spinning wheel includes a plurality of children seated in a circular configuration each of which having a number printed thereon;

providing six sets of question cards corresponding to the, four sections of the game board, a first set of questions relating to situations occurring at a bus stop and having a first color same as that of the first section, a second set of questions relating to situations occurring in a neighborhood and having the first color, a third set of questions relating to situations occurring at school and having a second color same as that of the second section, a fourth set of questions relating to situations related to fire safety and having a third color same as that of the fourth section, a fifth set of questions relating to situations on a playground and having the third color, a sixth set of questions relating to situations occurring at a shopping mall and having a fourth color same as that of the third section;

providing a set of parent cards having questions thereon relating to when a parent was a child, wherein the questions relate to the parent's life, past, present and future, whereby the child directs the questions to the parent;

starting the game by each of a plurality of players selecting a game piece;

each player taking a turn by spinning the numbered spinning wheel and advancing their game piece around the path of travel to a next location according to the number selected on the spinning wheel;

picking up one of the question cards pertaining to the section of the game board presently being occupied;

returning to a previous location until a next turn if a question is not answered correctly;

spinning the numbered wheel again and advancing to a next location at the next turn of each player when a question is answered correctly;

moving a player to the remote location marked "The Principal" upon answering a question incorrectly while in the second section and the third section and the player remaining in the location marked "The Principal" until the player's next turn, the player remaining in the location marked "The Principal" if the player continues to answer questions incorrectly on the player's subsequent turns, the player leaving the location marked "The Principal" and continuing advancement around the path of travel when the player answers a question correctly; and declaring as a winner a player who reaches the finishing point.

* * * * *